US005405821A

United States Patent [19]

Minami et al.

[11] Patent Number: 5,405,821

[45] Date of Patent: Apr. 11, 1995

[54] THERMAL RECORDING SHEET

[75] Inventors: Toshiaki Minami; Tadakazu Fukuchi, both of Tokyo, Japan

[73] Assignee: Nippon Paper Industries Co., Ltd., Tokyo, Japan

[21] Appl. No.: 111,924

[22] Filed: Aug. 26, 1993

[30] Foreign Application Priority Data

Aug. 28, 1992 [JP] Japan ..... 4-229526
Aug. 28, 1992 [JP] Japan ..... 4-229527

[51] Int. Cl.[6] ..... B41M 5/40

[52] U.S. Cl. ..... 503/207; 427/152; 503/200; 503/207; 503/216; 503/217; 503/221; 503/226

[58] Field of Search ..... 427/152; 503/200, 207, 503/209, 216, 217, 221, 226

[56] References Cited

FOREIGN PATENT DOCUMENTS 0237683 10/1986 Japan ..... 503/226

OTHER PUBLICATIONS

JIS Japanese Industrial Standard Methods of test for pigments JIS K 5101-1991.

*Primary Examiner*—B. Hamilton Hess
*Attorney, Agent, or Firm*—Sherman and Shalloway

[57] ABSTRACT

A thermal recording sheet superior in dynamic sensitivity, dot reproducibility, image quality and image storage stability, and having no trouble of turning yellow of the sheet caused by NOx gas.

A thermal recording sheet comprising an intermediate layer and a thermal color developing layer provided in turn on a substrate, wherein the intermediate layer contains a pigment having an oil absorption (according to JIS K5101) of less than 80 ml/100 g, and a compound of the following general formula (I):

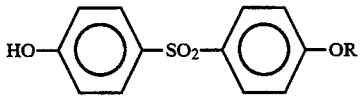

(I)

wherein R denotes propyl, isopropyl, or n-butyl, and calcium carbonate are contained in the thermal color developing layer as an organic color developer and a pigment, respectively.

7 Claims, No Drawings

THERMAL RECORDING SHEET

BACKGROUND OF THE INVENTION

1. Field of the Invention

The present invention relates to a thermal recording sheet which is superior in dynamic sensitivity, dot reproducibility, image quality, prevention of turning yellow by $NO_x$, image storage stability and printing aptitude.

2. Description of the Prior Art

In general, thermal recording sheets are normally prepared by individually grinding a colorless or pale colored basic chromogenic dye and an organic color developer such as a phenolic substance to disperse into fine particles, mixing, and further adding a binder, a filler, a sensitivity improver, a slip agent or other additives thereto to obtain a coating color, which is then coated on a substrate such as paper, synthetic paper, plastic films, cloths, and the like. The thermal recording sheet enables color recording by a momentary chemical reaction caused by heating with a thermal pen, a thermal head, a hot stamp, laser light, or the like.

The thermal recording sheets are applied in a variety of areas such as measurement recorders, computer terminal printers, facsimiles, automatic ticket vendors, and bar-code labels, however, with recent diversification and improvement of the recording devices, requirements to the thermal recording sheet have become stricter. For example, with increasing recording speed, it is required to obtain a high-density, sharp color image even with a small heat energy and, in addition, to have improved storage stability in terms of light resistance, weather resistance, and oil resistance.

Furthermore, with the diversification of market needs, demand is increasing for a thermal recording sheet which is superior in dot reproducibility and image quality over the energy regions from low energy to high energy.

At present, these thermal recording sheets have widely spread in medical field such as hospitals, etc. as a measurement paper for electrocardiogram. However, since clinical charts of electrocardiogram are preserved for a long time, there is a trouble with the conventional thermal recording papers which tend to turn yellow in the presence of the trace of NOx gas in the air during the preservation.

In addition, excellent printing aptitude is further required for measurement papers for electrocardiogram as the scales are also printed thereto.

SUMMARY OF THE INVENTION

It is an object of the present invention to provide a thermal recording sheet which is superior in dynamic sensitivity, dot reproducibility, image quality, resistance to turning yellow by NOx, image storage stability and printing aptitude.

The present invention is directed to a thermal recording sheet comprising by forming an intermediate layer and a thermal color developing layer containing a color developing agent and a color developer as the main components in turn on a substrate, wherein a pigment having an oil absorption (according to JIS K5101) of less than 80 ml/100 g is contained in the intermediate layer, and a compound represented by the following formula (I):

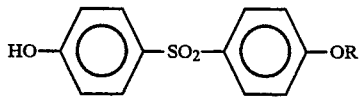

(I)

wherein R denotes propyl, isopropyl or n-butyl, as an organic color developer, 4-benzyloxy-4'-(2,3-epoxy-2-methylpropoxy)diphenylsulfone as a stabilizer and/or calcium carbonate as a pigment are contained in the thermal color developing agent and allowing to simultaneously solve the problems described above.

DETAILED DESCRIPTION OF THE INVENTION

In this invention, the pigment to be used in the intermediate layer is either an inorganic or organic pigment having an oil absorption (according to JIS K5101) of less than 80 ml/100 g. As the examples for the pigment described above, inorganic pigments such as almina, magnesium hydroxide, calcium hydroxide, magnesiun carbonate, zinc oxide, barium sulfate, silica, calcium carbonate, kaolin, calcined kaolin, diatomaceous earth, talc, titanium oxide, alminium hydroxide, and organic pigments such as urea-formalin resins, styrene-metacrylic acid copolymer, polystyrene resins and amino resin filler can be exemplified. Furthermore, other inorganic and organic pigments, which are obtained by physical or chemical processing of ordinary pigments so as to retain a specific oil absorption rate as described above, can be used if necessary. Among the various pigments indicated above, calcined kaolin is preferably used, because it has an excellent heat insulating effect which allows to give great improving effect on recording sensitivity. If the rate of oil absorption of the pigment is 80 ml/100 g or more, the binder component in both the intermediate layer and thermal color developing layer tend to be absorbed into the pigment at the coating of the intermediate layer and the following coating of the thermal color developing layer onto the substrate, thereby causing remarkable decrease in printing intensity.

The combining ratio of the pigment for the intermediate layer is not particularly limited, however, it is desirable to combine it at the rate of from 60 to 95% by weight, and preferably from 70 to 90% by weight. The amount of the pigment used for the coating is not specifically limited, and a normal amount for the coating is in the range of from about 2 to about 20 g/m$^2$, preferably from about 4 to about 10 g/m$^2$.

In the thermal color developing layer of this invention, a specified 4-hydroxyphenylarylsulfone color developer is used as a color developer. The examples for the color developer are listed as follows.

4-hydroxy-4'-isopropoxydiphenylsulfone
4-hydroxy-4'-n-propoxydiphenylsulfone
4-hydroxy-4'-n-butoxydiphenylsulfone Together with the above color developer, it is possible to use any of the following compound groups at the same time such as bisphenols A, 4-hydroxybenzoic esters, 4-hydroxyphthalic diesters, phthalic monoesters, bis-(hydroxyphenyl) sulfides, 4-hydroxyphenylarylsulfones, 4-hydroxyphenylarylsulfonates, 1,3-di [2-(hydroxyphenyl)-2-propyl]-benzenes, 4-hydroxybenzoyloxybenzoic esters, and bisphenolsulfones as much as the effect of the present invention could not be impaired. The practical examples for each compound group exemplified above are shown below.

Bisphenols A
4,4'-isopropylidene-diphenol (Bisphenol A)
4,4'-cyclohexylidene-diphenol
p,p'-(1-methyl-n-hexylidene)-diphenol
1,7-di(4-hydroxyphenylthio)-3,5-dioxaheptane
4-hydroxybenzoic esters
Benzyl-4-hydroxybenzoate
Ethyl-4-hydroxybenzoate
Propyl-4-hydroxybenzoate
Isopropyl-4-hydroxybenzoate
Butyl-4-hydroxybenzoate
Isobutyl-4-hydroxybenzoate
Methylbenzyl-4-hydroxybenzoate
4-hydroxyphthalic diesters
Dimethyl-4-hydroxyphthalate
Diisopropyl-4-hydroxyphthalate
Dibenzyl-4-hydroxyphthalate
Dihexyl-4-hydroxyphthalate
Phthalic monoesters
Monobenzylphthalic ester
Monocyclohexylphthalic ester
Monophenylphthalic ester
Monomethylphenylphthalic ester
Monoethylphenylphthalic ester
Monopropylbenzylphthalic ester
Monohalogenbenzylphthalic ester
Monoethoxybenzylphthalic ester
Bis-(hydroxyphenyl)-sulfides
Bis-(4-hydroxy-3-tert-butyl-6-methylphenyl)sulfide
Bis-(4-hydroxy-2,5-dimethylphenyl)sulfide
Bis-(4-hydroxy-2-methyl-5-ethylphenyl)sulfide
Bis-(4-hydroxy-2-methyl-5-isopropylphenyl)sulfide
Bis-(4-hydroxy-2,3-dimethylphenyl)sulfide
Bis-(4-hydroxy-2,5-dimethylphenyl)sulfide
Bis-(4-hydroxy-2,5-diisopropylphenyl)sulfide
Bis-(4-hydroxy-2,3,6-trimethylphenyl)sulfide
Bis-(2,4,5-trihydroxyphenyl)sulfide
Bis-(4-hydroxy-2-cyclohexyl-5-methylphenyl)sulfide
Bis-(2,3,4-trihydroxyphenyl)sulfide
Bis-(4,5-dihydroxy-2-tert-butylphenyl)sulfide
Bis-(4-hydroxy-2,5-diphenylphenyl)sulfide
Bis-(4-hydroxy-2-tert-octyl-5-methylphenyl)sulfide
4-Hydroxyphenylarylsulfonates
4-hydroxyphenylbenzenesulfonate
4-hydroxyphenyl-p-tolylsulfonate
4-hydroxyphenylmethylenesulfonate
4-hydroxyphenyl-p-chlorobenzenesulfonate
4-hydroxyphenyl-p-tert-butylbenzenesulfonate
4-hydroxyphenyl-p-isopropoxybenzenesulfonate
4-hydroxyphenyl-1'-naphthalenesulfonate
4-hydroxyphenyl-2'-naphthalenesulfonate
1,3-di[2-hydroxyphenyl)-2-propyl]benzene
1,3-di[2-(4-hydroxyphenyl)-2-propyl]benzene
1,3-di[2-(4-hydroxy-3-alkylphenyl)-2-propyl]benzene
1,3-di[2-(2,4-hydroxyphenyl)-2-propyl]benzene
1,3-di[2-(2,2-hydroxy-5-methylphenyl)-2-propyl]benzene
Resorcinols
1,3-dihydroxy-6-(α, α-dimethylbenzyl)-benzene
4-hydroxybenzoyloxybenzoic esters
Benzyl-4-hydroxybenzoyloxybenzoate
Methyl-4-hydroxybenzoyloxybenzoate
Ethyl-4-hydroxybenzoyloxybenzoate
Propyl-4-hydroxybenzoyloxybenzoate
Butyl-4-hydroxybenzoyloxybenzoate
Isopropyl-4-hydroxybenzoyloxybenzoate
tert-Butyl-4-hydroxybenzoyloxybenzoate
Hexyl-4-hydroxybenzoyloxybenzoate
Octyl-4-hydroxybenzoyloxybenzoate
Nonyl-4-hydroxybenzoyloxybenzoate
Cyclohexyl-4-hydroxybenzoyloxybenzoate
β-Phenethyl-4-hydroxybenzoyloxybenzoate
Phenyl-4-hydroxybenzoyloxybenzoate
α-Naphthyl-4-hydroxybenzoyloxybenzoate
β-Naphthyl-4-hydroxybenzoyloxybenzoate
sec-Butyl-4-hydroxybenzoyloxybenzoate
Bisphenolsulfonic acids (I)
Bis-(3-1-butyl-4-hydroxy-6-methylphenyl)sulfone
Bis-(3-ethyl-4-hydroxyphenyl)sulfone
Bis-(3-propyl-4-hydroxyphenyl)sulfone
Bis(3-methyl-4-hydroxyphenyl)sulfone
Bis(2-isopropyl-4-hydroxyphenyl)sulfone
Bis(2-ethyl-4-hydroxyphenyl)sulfone
Bis(3-chloro-4-hydroxyphenyl)sulfone
Bis(2,3-dimethyl-4-hydroxyphenyl)sulfone
Bis(2,5-dimethyl-4-hydroxyphenyl)sulfone
Bis(3-methoxy-4-hydroxyphenyl)sulfone
4-hydroxyphenyl-2'-ethyl-4'-hydroxyphenylsulfone
4-hydroxyphenyl-2'-isopropyl-4'-hydroxyphenylsulfone
4-hydroxyphenyl-3'-isopropyl-4'-hydroxyphenylsulfone
4-hydroxyphenyl-3'-sec-butyl-4'-hydroxyphenylsulfone
3-chloro-4-hydroxyphenyl-3'-isopropyl-4'-hydroxyphenylsulfone
2-hydroxy-5-t-butylphenyl-4'-hydroxyphenylsulfone
2-hydroxy-5-t-aminophenyl-4'-hydroxyphenylsulfone
2-hydroxy-5-t-isopropylphenyl-4'-hydroxyphenylsulfone
2-hydroxy-5-t-octylphenyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-2'-methyl-4'-hydroxyphenylsulfone
Bisphenolsulfonic acids (II)
4,4'-sulfonyldiphenol
2,4'-sulfonyldiphenol
3,3'-dichloro-4,4'-sulfonyldiphenol
3,3'-dibromo-4,4'-sulfonyldiphenol
3,3',5,5'-tetrabromo-4,4'-sulfonyldiphenol
3,3'-diamino-4,4'-sulfonyldiphenol
Others
p-tert-Butylphenol
2,4-dihydroxybenzophenone
Novolac type phenolic resin
4-hydroxyacetophenone
p-Phenylphenol
Benzyl-4-hydroxyphenylacetate
p-Benzylphenol In the thermal color developing layer of this invention, calcium carbonate is used as a pigment. With other pigments than calcium carbonate, the preventive effect on the turning yellow by NOx described above cannot be obtained at all. Calcium carbonate with the average particle size of from about 0.1 to 1.0μ is preferably used, and the particles in large size is not preferable for obtaining good dot reproducibility and image quality over the wide energy regions from low energy to high energy.

In addition, as the stabilizer, 4-benzyloxy-4'-(2,3-epoxy-2-methylpropoxy)diphenylsulfone is contained in the thermal color developing layer.

The basic colorless dye used in the present invention is not specifically limited, however, it is preferable to use triphenylmethane dyes, fluoran dyes, fluorene dyes, or the like, and practical examples for these dyes are listed below.

Triphenylmethane leuco dyes
3,3-bis(p-dimethylaminophenyl)-6-dimethylaminophthalide
[Other name: Crystal violet lactone]
Fluoran leuco dyes (I)
3-diethylamino-6-methyl-7-anilinofluoran
3-(N-ethyl-p-toluidino)-6-methyl-7-anilinofluoran
3-(N-ethyl-N-isoamylamino)-6-methyl-7-anilinofluoran
3-diethylamino-6-methyl-7-(o,p-dimethylanilino)fluoran
3-pyrrolidino-6-methyl-7-anilinofluoran
3-piperidino-6-methyl-7-anilinofluoran
3-(N-cyclohexyl-N-methylamino)-6-methyl-7-anilinofluoran
3-diethylamino-7-(m-trifluoromethylanilino)fluoran
3-N-dibutylamino-6-methyl-7-anilinofluoran
3-N-n-dibutylamino-7-(o-chloroanilino)fluoran
3-(N-ethyl-N-tetrahydrofurfurylamino)-6-methyl-7-anilinofluoran
3-dibutylamino-6-methyl-7-(o,p-dimethylanilino)-fluoran
3-N-methyl-N-propylamino)-6-methyl-7-anilinofluoran
3-diethylamino-6-chloro-7-anilinofluoran
3-dibutylamino-7-(o-chloroanilino)fluoran
3-diethylamino-7-(o-chloroanilino)fluoran
3-diethylamino-6-methyl-7-(m-methylanilino)fluoran
3-n-dibutylamino-6-methyl-7-(m-methylanilino)fluoran
3-diethylamino-6-methyl-chlorofluoran
3-diethylamino-6-methyl-fluoran
3-cyclohexylamino-6-chlorofluoran
3-diethylamino-benzol[a]-fluoran
3-n-diphenylamino-6-methyl-7-anilinofluoran
2-(4-oxo-hexyl)-3-dimethylamino-6-methyl-7-anilinofluoran
2-(4-oxo-hexyl)-3-diethylamino-6-methyl-7-anilinofluoran
2-(4-oxo-hexyl)-3-dipropylamino-6-methyl-7-anilinofluoran
Fluorene leuco dyes
3,6,6'-tris(dimethylamino)spiro[fluorene-9,3'-phthalide]
3,6,6'-tris(diethylamino)spiro[fluorene-9,3'-phthalide]
Fluoran leuco dyes (II)
2-methyl-6-p-(p-dimethylaminophenyl)aminoanilinofluoran
2-methoxy-6-p-(p-dimethylaminophenyl-)aminoanilinofluoran
2-chloro-3-methyl-6-p-(p-phenylaminophenyl-)aminoanilinofluoran
2-chloro-6-p-(p-dimethylaminophenyl)aminoanilinofluoran
2-nitro-6-p-(p-dimethylaminophenyl)aminoanilinofluoran
2-amino-6-p-(p-dimethylaminophenyl)aminoanilinofluoran
2-diethylamino-6-p-(p-dimethylaminophenyl-)aminoanilinofluoran
2-phenyl-6-methyl-6-p-(p-phenylaminophenyl-)aminoanilinofluoran
2-benzyl-6-p-(p-phenylaminophenyl)aminoanilinofluoran
2-hydroxy-6-p-(p-phenylaminophenyl)aminoanilinofluoran
3-methyl-6-p-(p-dimethylaminophenyl)aminoanilinofluoran
3-diethylamino-6-p-(p-diethylaminophenyl-)aminoanilinofluoran
3-diethylamino-6-p-(p-dibutylaminophenyl-)aminoanilinofluoran
Divinyl leuco dyes
3,3-bis-[2-(p-dimethylaminophenyl)-2-(p-methoxyphenyl)ethenyl]-4,5,6,7-tetrabromophthalide
3,3-bis-[2-(p-dimethylaminophenyl)-2-(p-methoxyphenyl)ethenyl]-4,5,6,7-tetrachlorophthalide
3,3-bis-[1,1-bis(4-pyrrolidinophenyl)-ethylene-2-yl]-4,5,6,7-tetrabromophthalide
3,3-bis-[1-(4-methoxyphenyl)-1-(4-pyrrolidinophenyl-)ethylene-2-yl]-4,5,6,7-tetrachlorophthalide
Others
1,1-bis-[2',2',2'',2''-tetrakis-(p-dimethylaminophenyl)-ethenyl]-2,2-dinitrileethane
1,1-bis-[2',2',2'',2''-tetrakis-(p-dimethylaminophenyl)-ethenyl]-2, β-naphthoylethane
1,1-bis-[2',2',2'',2''-tetrakis-(p-dimethylaminophenyl)-ethenyl]-2,2-diacetylethane
Bis-[2,2,2',2'-tetrakis-(p-dimethylaminophenyl)ethenyl]-methylmalonate dimethylester These dyes can be used alone or as mixture of two or more.

Furthermore, as a sensitizer, fatty acid amides such as stearamide, palmitamide, or the like; ethylene-bisamide, montan wax, polyethylene wax, dibenzyl terephthalate, benzyl p-benzyloxybenzoate, di-p-tolylcarbonate, p-benzylbiphenyl, phenyl-α-naphthylcarbonate, 1,4-diethoxynaphthalene, 1-hydroxy-2-naphthoate phenylester, 1,2-di-(3-methylphenoxy) ethane, di(p-methylbenzyl)oxalate, β-benzyloxynaphthalene, 4-biphenyl-p-tolylether, o-xylylene-bis-(phenylether), 4-(m-methylphenoxymethyl)biphenyl, or the like can be added to the thermal color developing layer.

In the present invention, the following binders can be used in both the intermediate and thermal color developing layers, for examples, completely-hydrolyzed polyvinylalcohol with a polymerization degree of 200 to 1,900, partially-hydrolyzed polyvinylalcohol, carboxy-modified polyvinylalcohol, amide-modified polyvinylalcohol, sulfonic acid-modified polyvinylalcohol, butyral-modified polyvinylalcohol, and other modified polyvinylalcohols, hydroxyethylcellulose, methylcellulose, carboxymethylcellulose, styrene-maleic anhydride copolymer, styrene-butadiene copolymer, styrene-acrylate copolymer, acrylonitrile-butadiene copolymer; cellulose derivatives such as ethylcellulose and acetylcellulose; polyvinylchloride, polyvinylacetate, polyacrylamide, polyacrylic esters, polyvinylbutyral polystyrene and those copolymers, polyamide resins, silicon resins, petroleum resins, terpene resins, ketone resins, coumarone resins, starch, starch derivatives, and casein. These polymeric substances are used in a state emulsified in water or vehicles, or can be used in the combination thereof according to the quality requirements.

In the present invention, it is also possible to add known stabilizers such as the metal salts (Ca and Zn) of p-nitrobenzoic acid or those of monobenzylphthalate as much as the effect of the present invention could not be impaired.

Further to the above, it is still possible to add releasing agents such as fatty acid metal salts, slip agents such as waxes, benzophenone- and triazole-based ultraviolet absorbers, water resistant agents such as glyoxal, dispersants, deformers and the like.

The amount of the organic color developer and the basic colorless dye to be used in this invention, and the kinds and the amounts of other components will be determined according to the required properties and recording adaptabilities of the thermal recording sheets, and are not specifically limited, but it is usually preferable to use 1 to 8 parts of the organic color developer, 0.15 to 3 parts of the stabilizer and 1 to 20 parts of the filler relatively to 1 part of the basic colorless dye, and the binder is preferably used in an amount of 10 to 25% by weight relatively to the total solid substances.

The coating color prepared in accordance with the composition described above can be coated on any type of substrate such as papers, plastic films, non-woven fabrics or the like, affording the objective thermal recording sheets.

For the improvement of the storage stability, the thermal color developing layer can be additionally provided with an overcoating layer comprising a pigment containing polymeric substance thereon, or a backcoating layer comprising a polymeric substance on the substrate described above.

All of the organic color developer, the basic colorless dye and the other optional additives are micronized up to obtaining the particle size of few micron or less by using a pulverizer or an appropriate emulsifying machine such as ball mill, attriter, sand grinder, etc., and then added with binder and required additives to obtain desired coating color.

For the thermal recording sheets of the present invention, though the method for coating the intermediate layer and the thermal color developing layer are not specifically limited, these layers can be coated by a customary methods in the art, so that off-machine coater or on-machine coater equipped with various coaters such as air knife coater, rod blade coater, bill blade coater, roll coater, etc. can be used at appropriate option.

Moreover, it is possible to apply smoothing processing to each layer by super-calendaring or the like after coating and drying the intermediate and thermal color developing layers, if necessary.

OPERATION

The mechanism how this invention can accomplish its object of providing thermal recording sheets having various superior properties by coating the specific intermediate layer and the thermal color developing layers on the substrate in turn can be explained as follows.

In the embodiment of this invention, an intermediate layer, containing a specific pigment having oil absorption of less than 80 ml/100 g as the main component, is provided between the substrate and the thermal color developing layer. In the above structure, the intermediate layer fills and smooths microscopic irregularities on the surface of the base paper to suppress the penetration of the coating color for the thermal color developing layer subsequently applied and simultaneously provide heat insulating layer with high void fraction therein, thereby enabling to form uniform coating of the thermal color developing layer on the sheet. As a result, dynamic sensitivity, dot reproducibility, image quality and printing aptitude are improved with the thermal recording sheet prepared according to this invention.

Further to the above effects, the color change of the thermal recording sheets to yellow can be prevented, since chemical change of the color developer comprising phenolic compound to quinine compound is prevented even under the atmosphere of NOx gas due to the interaction of the color developer comprising specific 4-hydroxyphenylarylsulfone and calcium carbonate as pigment both of which are contained in the thermal color developing layer, thereby allowing to improve printing aptitude which could be also supported by the formation of the intermediate layer. In addition, image storage stability on the sheet according to this invention can also be improved by adding 4-benzyloxy-4'-(2,3-epoxy-2-methylpropoxy)diphenylsulfone as stabilizer in the thermal color developing layer as described above.

EXAMPLES

The present invention will now be described with reference to the examples. In the description, part means part by weight.

[Example 1]

| (Formation of Intermediate Layer) | |
|---|---|
| Calcined kaolin (Trade name: XC1300F, ECC, Oil absorption: 70 ml/100 g) | 100 parts |
| Styrene-butadiene copolymer latex (Solid content: 48%) | 11 |
| 10% Aqueous polyvinylalcohol aqueous solution | 5 |

The above compositions were blended to obtain various coating colors for the intermediate layer. These coating colors in an amount of 6 g/m$^2$ in dry weight were coated on the surface of fine papers in a quantity of 50 g/m$^2$ and dried.

| (Formation of Thermal color developing layer) | |
|---|---|
| Solution A (Color Developer Dispersion) | |
| 4-hydroxy-4'-isopropoxydiphenylsulfone | 6.0 parts |
| 10% Polyvinylalcohol aqueous solution | 18.8 |
| Water | 11.2 |
| Solution B (Dye Dispersion) | |
| 3-N-n-dibutylamino-6-methyl-7-anilinofluoran | 2.0 parts |
| 10% Polyvinylalcohol aqueous solution | 4.6 |
| Water | 2.6 |
| Solution C (Sensitizer Dispersion) | |
| 4-biphenyl-p-tolylether | 4.0 parts |
| 10% Polyvinyl aqueous solution | 5.0 |
| Water | 3.0 |

Each of the solutions according to the above composition were ground by using sand grinder up to the particle size of 1$\mu$ in average. The ground solutions were then mixed according to the following recipe to obtain the coating color.

| | |
|---|---|
| Solution A | 36.0 parts |

-continued

| | |
|---|---|
| Solution B | 9.2 |
| Solution C | 12.0 |
| Calcium carbonate (Trade name: Brilliant-15, Shiraishi Kogyo, Average particle size 0.20μ, 50% dispersion) | 12.0 |

The coating color for the thermal color developing layer obtained according to the above recipe was then coated to the surface of the intermediate layer at the rate of 5.0 g/m$^2$ in dry weight and dried. The coated sheets were then exposed to super-calendaring to obtain the thermal recording sheets having a smoothness of from 700 to 800 seconds.

[Example 2]

| (Formation of Intermediate Layer) | |
|---|---|
| Calcined kaolin (Trade name: Deltatex, ECC, Oil absorption: 70 ml/100 g) | 100 parts |
| Styrene-butadiene copolymer latex (Solid content 48%) | 11 |
| 10% Polyvinylalcohol aqueous solution | 5 |

Each of the above compositions were mixed to obtain the coating color. The coating color in an amount of 6 g/m$^2$ in dry weight was then coated to the surface of fine papers in a quantity of 50 g/m$^2$ and dried.

| (Formation of Thermal Color Developing Layer) | |
|---|---|
| Solution D (Color Developer Dispersion) | |
| 4-hydroxy-4'-n-propoxydiphenylsulfone | 6.0 parts |
| 10% Polyvinylalcohol aqueous solution | 18.8 |
| Water | 11.2 |
| Solution B (Dye Dispersion) | |
| 3-N-n-dibutylamino-6-methyl-7-anilinofluoran | 2.0 parts |
| 10% Polyvinylalcohol aqueous solution | 4.6 |
| Water | 2.6 |
| Solution C (Sensitizer Dispersion) | |
| 4-biphenyl-p-tolyl ether | 4.0 parts |
| 10% Polyvinylalcohol aqueous solution | 5.0 |
| Water | 3.0 |

Each of the solutions according to the above composition were ground by using sand grinder up to the particle size of 1μ in average. The ground solutions were then mixed according to the following recipe to obtain the coating color.

| | |
|---|---|
| Solution D | 36.0 parts |
| Solution B | 9.2 |
| Solution C | 12.0 |
| Calcium carbonate (Trade name: Tunex E, Shiraishi Kogyo, Average particle size 0.33μ, 50% dispersion) | 12.0 |

The coating color for the thermal color developing layer obtained according to the above recipe was then coated to the surface of the intermediate layer at the rate of 5.0 g/m$^2$ in dry weight and dried. The coated sheets were then exposed to super-calendaring to obtain the thermal recording sheets having a smoothness of from 700 to 800 seconds.

[Example 3]

| (Formation of Intermediate Layer) | |
|---|---|
| Calcined kaolin (Trade name: HUBER 80C, HUBER, Oil absorption: 60 ml/100 g) | 100 parts |
| Styrene-butadiene copolymer latex (Solid content: 48%) | 11 |
| 10% Polyvinylalcohol aqueous solution | 5 |

Each of the above compositions were mixed to obtain the coating color. The coating color in an amount of 6 g/m$^2$ in dry weight was then coated to the surface of fine papers in a quantity of 50 g/m$^2$ and dried.

| (Formation of thermal Color Developing Layer) | |
|---|---|
| Solution E (Color Developer Dispersion | |
| 4-hydroxy-4'-n-butoxydiphenylsulfone | 6.0 parts |
| 10% Polyvinylalcohol aqueous solution | 18.8 |
| Water | 11.2 |
| Solution B (Dye Dispersion) | |
| 3-N-n-dibutylamino-6-methyl-7-anilinofluoran | 2.0 parts |
| 10% Polyvinylalcohol aqueous solution | 4.6 |
| Water | 2.6 |
| Solution C (Sensitizer Dispersion) | |
| 4-biphenyl-p-talylether | 4.0 parts |
| 10% Polyvinylalcohol aqueous solution | 5.0 |
| Water | 3.0 |

Each of the solutions according to the above composition were ground by using sand grinder up to the particle size of 1μ in average. The ground solutions were then mixed according to the following recipe to obtain the coating color.

| | |
|---|---|
| Solution E | 36.0 parts |
| Solution B | 9.2 |
| Solution C | 12.0 |
| Calcium carbonate (Trade name: Unibur-70, Shiraishi Kogyo, Average particle size 0.17μ, 50% dispersion) | 12.0 |

The coating color for the thermal color developing layer obtained according to the above recipe was then coated to the surface of the intermediate layer at the rate of 5.0 g/m$^2$ in dry weight and dried. The coated sheets were then exposed to super-calendaring to obtain the thermal recording sheets having a smoothness of from 700 to 800 seconds.

[Comparative Example 1]

The thermal recording papers were prepared in accordance with the same procedure as described in Example 1 except to replace 4-hydroxy-4'-isopropoxydiphenylsulfone contained in the solution A (color developer) with 4,4'-isopropylidenediphenol.

[Comparative Example 2]

The thermal recording papers were prepared in accordance with the same procedure as described in Example 1 except to replace calcium carbonate added to the coating color for the thermal color developing layer with silicon dioxide (Trade name: Nipsil E-743, Nippon Silica, 50% dispersion).

[Comparative Example 3]

The thermal recording papers were prepared in accordance with the same procedure as described in Example 1 except to replace the calcined kaolin (Trade name: XC1300F, ECC, Oil absorption: 70 ml/100 g) with another calcined kaolin (Trade name: AN- SILEX90, ENGELHARD, Oil absorption: 90 ml/100 g) at the process of forming the intermediate layer.

[Comparative Example 4]

The thermal recording papers were prepared in accordance with the same procedure as described in Example 1 except to replace the calcined kaolin (Trade name: XC1300F, ECC, Oil absorption: 70 ml/100 g) with another calcined kaolin (Trade name: AN-SILEX90, ENGELHARD, Oil absorption: 90 ml/100 g) at the process of forming the intermediate layer, 4-hydroxy-4'-isopropoxydiphenylsulfone with 4,4'-isopropylidenediphenol, and calcium carbonate added to the coating color for the thermal color developing layer with silicon dioxide (Trade name: Nipsil E-743, Nippon Silica, 50% dispersion).

A summary of the test results on the quality of the thermal recording sheets obtained in the Examples and the Comparative examples is shown in Table 1.

TABLE 1

Test Results on Quality and Performance of Thermal Recording Sheets

| | Dynamic Color Developing Density[1] | Dot Reproducibility[2] | Turning Yellow by NOx[3] | Printing Aptitude[4] | Total Evaluation[5] |
|---|---|---|---|---|---|
| Example 1 | 1.05 | ○ | ○ | ○ | ○ |
| 2 | 1.06 | ○ | ○ | ○ | ○ |
| 3 | 1.04 | ○ | ○ | ○ | ○ |
| Comparative | | | | | |
| Example 1 | 0.99 | Δ | X | Δ | X |
| 2 | 0.98 | ○ | Δ | X | X |
| 3 | 0.97 | ○ | Δ | X | X |
| 4 | 0.98 | ○ | X | X | X |

Note: [1]Dynamic color developing density: Image density recorded by using Matsushita Denso Thermal Facsimile UF-1000B at a voltage of 14.7V, a resistance of 360Ω, a pulse width of 0.82 ms, and an applied energy of 0.49 mj/dot was measured by Macbeth densitometer (RD-914, amber filter used. The same as follows).

Note: [2]Dot reproducibility: Printed dot shape of the images dynamically recorded by the method of (1) was visually observed. The results were shown with the following indications.

○: Good reproducibility

Δ: Slightly inferior reproducibility

X: Inferior reproducibility

Note: [3]Turnwng yellow by NOx: A given volume of phosphoric acid aqueous solution was mixed with sodium nitrite aqueous solution in a closed container to generate NOx gas, and the sample of the undeveloped thermal recording sheet was placed in an atmosphere of NOx for 30 min., then the samples were taken out therefrom for measuring the degree of turning yellow by visual observations. The degree of the turning yellow was evaluated according to the following indication.

○: Substantially no turning yellow was observed.

Δ: Slight turning yellow was observed.

X: Great extent of turning yellow was observed.

Note: [4]Printing aptitude: For ink, WEB KING GS-R (Black, Toyo ink) was used in this tests, and the printing aptitude of the thermal recording sheets such as adhesion and strength of the printed surface was evaluated by using rotary inking tester. The results were expressed as the following indications.

○: Excellent printing aptitude

Δ: Slight inferior printing aptitude

X: Inferior printing aptitude

Note: [5]Total evaluation: Dynamic color developing density, dot reproducibility, turning yellow by NOx, and printing aptitude are totally evaluated.

Note: 1) Dynamic color developing density: Image density recorded by using Matsushita Denso Thermal Facsimile UF-1000B at a voltage of 14.7V, a resistance of 360 Ω, a pulse width of 0.82 ms, and an applied energy of 0.49 mj/dot was measured by Macbeth densitometer (RD-914, amber filter used. The same as follows).

Note: 2) Dot reproducibility: Printed dot shape of the images dynamically recorded by the method of (1) was visually observed. The results were shown with the following indications.

○: Good reproducibility

Δ: Slightly inferior reproducibility

×: Inferior reproducibility

Note: 3) Turning yellow by NOx: A given volume of phosphoric acid aqueous solution was mixed with sodium nitrite aqueous solution in a closed container to generate NOx gas, and the sample of the undeveloped thermal recording sheet was placed in an atmosphere of NOx for 30 min., then the samples were taken out therefrom for measuring the degree of turning yellow by visual observations. The degree of the turning yellow was evaluated according to the following indication.

○: Substantially no turning yellow was observed.

Δ: Slight turning yellow was observed.

×: Great extent of turning yellow was observed.

Note: 4) Printing aptitude: For ink, WEB KING GS-R (Black, Toyo ink) was used in this tests, and the printing aptitude of the thermal recording sheets such as adhesion and strength of the printed surface was evaluated by using rotary inking tester. The results were expressed as the following indications.

○: Excellent printing aptitude

Δ: Slight inferior printing aptitude

×: Inferior printing aptitude

Note: 5) Total evaluation: Dynamic color developing density, dot reproducibility, turning yellow by NOx, and printing aptitude are totally evaluated.

[Example 4]

| (Formation of Intermediate Layer) | |
|---|---|
| Calcined kaolin (Trade name: XC1300F, ECC, Oil absorption: 70 ml/100 g) | 100 parts |
| Styrene-butadiele copolymer latex (Solid content: 48%) | 11 |
| 10% Polyvinylalcohol aqueous solution | 5 |

Each of the above compositions were mixed to obtain the coating color. The coating color in an amount of 6 g/m$^2$ in dry weight was then coated to the surface of fine papers in a quantity of 50 g/m$^2$ and dried.

| (Formation of Thermal Color Developing Layer) |
|---|
| Solution A (Color Developer Dispersion) |

-continued

| (Formation of Thermal Color Developing Layer) | |
|---|---|
| 4-hydroxy-4'-isopropoxydiphenylsulfone | 6.0 parts |
| 10% Polyvinylalcohol aqueous solution | 18.8 |
| Water | 11.2 |
| Solution B (Dye Dispersion) | |
| 3-N-n-dibutylamino-6-methyl-7-anilinofluoran | 2.0 parts |
| 10% Polyvinylalcohol aqueous solution | 4.6 |
| Water | 2.6 |
| Solution C (Sensitizer Dispersion) | |
| 4-benzyloxy-4'-(2,3-epoxy-2-methylpropoxy) diphenylsulfone | 4.0 parts |
| 10% Polyvinylalcohol aqueous solution | 5.0 |
| Water | 3.0 |

Each of the solutions according to the above composition were ground by using sand grinder up to the particle size of 1μ in average. The ground solutions were then mixed according to the following recipe to obtain the coating color.

| | |
|---|---|
| Solution A | 36.0 parts |
| Solution B | 9.2 |
| Solution C | 12.0 |
| Calcium carbonate (Trade name: Brilliant 15, Shiraishi Kogyo, Average particle size 0.17μ, 50% dispersion) | 12.0 |

The coating color for the thermal color developing layer was then coated to the surface of the intermediate layer obtained as described above at the rate of 5.0 g/m$^2$ in dry weight and dried. The coated sheets were then exposed to super-calendaring to obtain the thermal recording sheets having a smoothness of from 700 to 800 seconds.

[Example 5]

| (Formation of Intermediate Layer) | |
|---|---|
| Calcined kaolin (Trade name: DELTATEX, ECC, Oil absorption: 70 ml/100 g) | 100 parts |
| Styrene-butadiene copolymer latex (Solid content: 48%) | 11 |
| 10% Polyvinylalcohol aqueous solution | 5 |

Each of the above compositions were mixed to obtain the coating color. The coating color in an amount of 6 g/m$^2$ in dry weight was then coated to the surface of fine papers in a quantity of 50 g/m$^2$ and dried.

| (Formation of Thermal Color Developing Layer) | |
|---|---|
| Solution D (Color Developer Dispersion) | |
| 4-hydroxy-4'-isopropoxydiphenylsulfone | 6.0 parts |
| 10% Polyvinylalcohol aqueous solution | 18.8 |
| Water | 11.2 |
| Solution B (Dye Dispersion) | |
| 3-N-n-dibutylamino-6-methyl-7-anilinofluoran | 2.0 parts |
| 10% Polyvinylalcohol aqueous solution | 4.6 |
| Water | 2.6 |
| Solution C (Stabilizer Dispersion) | |
| 4-benzyloxy-4'-(2,3-epoxy-2-methylpropoxy) diphenylsulfone | 4.0 parts |
| 10% Polyvinylalcohol aqueous solution | 5.0 |
| Water | 3.0 |

Each of the solutions according to the above composition were ground by using sand grinder up to the particle size of 1μ in average. The ground solutions were then mixed according to the following recipe to obtain the coating color.

| | |
|---|---|
| Solution D | 36.0 parts |
| Solution B | 9.2 |
| Solution C | 12.0 |
| Calcium carbonate (Trade name: Tunex E, Shiraishi Kogyo, Average particle size 0.33μ, 50% dispersion) | 12.0 |

The coating color for the thermal color developing layer was then coated to the surface of the intermediate layer obtained as described above at the rate of 5.0 g/m$^2$ in dry weight and dried. The coated sheets were then exposed to super-calendaring to obtain the thermal recording sheets having a smoothness of from 700 to 800 seconds.

[Example 6]

| (Formation of Intermediate Layer) | |
|---|---|
| Calcined kaolin (Trade name: HUBER 80C, HUBER, Oil absorption: 70 ml/100 g) | 100 parts |
| Styrene-butadiene copolymer latex (Solid content: 48%) | 11 |
| 10% Polyvinylalcohol aqueous solution | 5 |

Each of the above compositions were mixed to obtain the coating color. The coating color in an amount of 6 g/m$^2$ in dry weight was then coated to the surface of fine papers in a quantity of 50 g/m$^2$ and dried.

| (Formation of Thermal Color Developing Layer) | |
|---|---|
| Solution E (Color Developer Dispersion) | |
| 4-hydroxy-4'-n-butoxydiphenylsulfone | 6.0 parts |
| 10% Polyvinylalcohol aqueous solution | 18.8 |
| Water | 11.2 |
| Solution B (Dye Dispersion) | |
| 3-N-n-dibutylamino-6-methyl-7-anilinofluoran | 2.0 parts |
| 10% Polyvinylalcohol aqueous solution | 4.6 |
| Water | 2.6 |
| Solution C (Stabilizer Dispersion) | |
| 4-benzyloxy-4'-(2,3-epoxy-2-methylpropoxy) diphenylsulfone | 4.0 parts |
| 10% Polyvinylalcohol aqueous solution | 5.0 |
| Water | 3.0 |

Each of the solutions according to the above composition were ground by using sand grinder up to the particle size of 1μ in average. The ground solutions were then mixed according to the following recipe to obtain the coating color.

| | |
|---|---|
| Solution E | 36.0 parts |
| Solution B | 9.2 |
| Solution C | 12.0 |
| Calcium carbonate (Trade name: Unibur-70, Shiraishi Kogyo, Average particle size 0.17μ, 50% dispersion) | 12.0 |

The coating color for the thermal color developing layer was then coated to the surface of the intermediate layer obtained as described above at the rate of 5.0 g/m$^2$ in dry weight and dried. The coated sheets were then exposed to super-calendaring to obtain the thermal recording sheets having a smoothness of from 700 to 800 seconds.

A summary of the test results on the quality of the thermal recording sheets obtained in the Examples and the Comparative Examples is shown in Table 2.

TABLE 2

Test Results on Quality and Performance of Thermal Recording Sheets

| | Dynamic Color Developing Density[6] | Dot Reproducibility | Turning Yellow by NOx | Printing Aptitude | Oil Resistance[7] | | | Total Evaluation[8] |
|---|---|---|---|---|---|---|---|---|
| | | | | | Untreated | Oil-treated | % Remained | |
| Example | | | | | | | | |
| 4 | 1.07 | ○ | ○ | ○ | 1.07 | 1.02 | 95 | ○ |
| 5 | 1.04 | ○ | ○ | ○ | 1.04 | 0.98 | 94 | ○ |
| 6 | 1.05 | ○ | ○ | ○ | 1.06 | 1.02 | 96 | ○ |

Note: [6]Dynamic color developing density: Image density recorded by using Matsushita Denso Thermal Facsimile UF-1000B at a voltage of 14.7 V, a resistance of 360 Ω, a pulse width of 0.82 ms, and an applied energy of 0.63 mj/dot is measured by Macbeth densitometer (RD-914, amber filter used. The same as follows).

Note: [7]Oil resistance: The samples of the thermal recording sheets dynamically recorded in accordance with the method described in Note 1) were fed dropwise with salad oil, then the applied oil was quickly removed with filtering paper after 10 seconds. After leaving the sheets for an hour at room temperature, the image density was measured by using Macbeth densitometer. The remaining ratio of the image was calculated according to the equation described below.

[Equation 1]

$$\text{Remaining ratio} = \frac{\text{Image Density after Oil Treatment}}{\text{Image Density with No Oil Treatment}} \times 100\ \%$$

Note: [8]Total evaluation: Dynamic color developing density, dot reproducibility, turning yellow by NOx, oil resistance, and printing aptitude are totally evaluated.

Advantageous Effects of the Invention

The followings can be exemplified as advantageous effects of the thermal recording sheets of this invention.

(1) Because of the superior heat response of the thermal recording sheets, a sharp, high-density images can be obtained even in high-speed, high-density recording.

(2) The thermal recording sheets are superior in dot reproducibility and image quality.

(3) The thermal recording sheets do not have a problem of turning yellow thereof cause by NOx even preserving them for a long time.

(4) The thermal recording sheets are superior in printing aptitude at UV printing and non-UV printing.

(5) The developed color on the thermal recording sheet is not substantially decolored even contacted with a plasticizer, salad oil, vinegar and the like.

What we claim is:

1. A thermal recording sheet comprising by providing an intermediate layer and a thermal color developing layer containing a color developing agent and a color developer as main components in turn on a substrate, wherein the intermediate layer contains a pigment having an oil absorption according to JIS K5101 of less than 80 ml/100 g and the thermal color developing layer contains a compound represented by the following general formula (I):

(I)

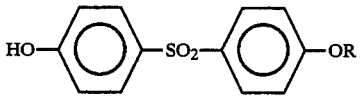

wherein R denotes propyl, isopropyl, or n-butyl, as an organic color developer and calcium carbonate as a pigment.

2. The thermal recording sheet of claim 1 wherein said thermal color developing layer further contains 4-benzyloxy-4'-(2,3-epoxy-2-methylpropoxy)diphenylsulfone as a stabilizer.

3. The thermal recording sheet of claim 1 or 2 wherein a color developing agent is a fluoran dye.

4. The thermal recording sheet of claim 1 or 2 wherein said pigment having an oil absorption according to JIS K5101 of less than 80 ml/100 g is an inorganic pigment.

5. The thermal recording sheet of claim 4 wherein said inorganic pigment is calcined kaolin.

6. The thermal recording sheet of claims 1 or 2 wherein said pigment is contained in the intermediate layer in an amount of a range of from 70% to 90% by weight relatively to total solid of the intermediate layer.

7. The thermal recording sheet of claim 1 or 2 wherein the coat weight of the intermediate layer is in a range of from 2 to 20 g/m$^2$.

* * * * *